US007195505B1

(12) United States Patent
Becker

(10) Patent No.: US 7,195,505 B1
(45) Date of Patent: Mar. 27, 2007

(54) CONNECTOR ASSEMBLY

(75) Inventor: Timothy D. Becker, Cypress, TX (US)

(73) Assignee: OYO GeoSpace Corporation, Houston, TX (US)

( * ) Notice: Subject to any disclaimer, the term of this patent is extended or adjusted under 35 U.S.C. 154(b) by 0 days.

(21) Appl. No.: 11/269,368

(22) Filed: Nov. 8, 2005

Related U.S. Application Data

(60) Provisional application No. 60/625,833, filed on Nov. 8, 2004.

(51) Int. Cl.
*H01R 13/52* (2006.01)

(52) U.S. Cl. ..... 439/282; 439/271

(58) Field of Classification Search ..... 439/282, 439/271, 277, 320, 604, 606; 385/60
See application file for complete search history.

(56) References Cited

U.S. PATENT DOCUMENTS 3,960,429 A * 6/1976 Moulin ..... 439/352
3,960,433 A 6/1976 Boliver
4,217,030 A * 8/1980 Howarth ..... 385/64
4,432,604 A * 2/1984 Schwab ..... 385/60
4,637,674 A 1/1987 Kobler
4,895,533 A 1/1990 Yagi et al.
4,904,198 A 2/1990 Begitschke et al.
5,120,268 A 6/1992 Gerrans
5,226,832 A * 7/1993 Dejardin et al. ..... 439/274
5,980,317 A 11/1999 McNeel
5,984,724 A 11/1999 McNeel
6,053,754 A 4/2000 Kano et al.
6,206,579 B1 * 3/2001 Selfridge et al. ..... 385/60
6,623,289 B2 * 9/2003 Decicco ..... 439/271

* cited by examiner

*Primary Examiner*—Neil Abrams
*Assistant Examiner*—Harshad C Patel
(74) *Attorney, Agent, or Firm*—Gary L. Bush; Andrews Kurth LLP

(57) ABSTRACT

An apparatus for producing a watertight connection for the purpose of joining electrical or optical circuits including, in a preferred embodiment, a male connector with a cylindrical plug characterized by having a first groove and a first raised seal disposed about the plug's outer side surface and a female connector with a cylindrical receptacle characterized by a second groove and a second raised seal disposed about receptacle's inner side surface, such that the seal of the plug is received in the groove of the receptacle, and groove of the plug receives the seal of the receptacle, thereby operatively coupling the contacts in a redundantly sealed environment. The first and second grooves are disposed distal to the raised seals (with respect the cable end of the connectors) so that when the connector pair is mated, the grooves pass each other without interference and the seals simultaneously engage the grooves.

18 Claims, 4 Drawing Sheets

CONNECTOR ASSEMBLY

CROSS REFERENCE TO RELATED APPLICATION

This application is based upon provisional application 60/625,833 filed on Nov. 8, 2004, the priority of which is claimed.

BACKGROUND OF THE INVENTION

1. Field of the Invention

This invention relates generally to the field of electrical or fiber-optic connectors possessing moisture and water proof integrity. More specifically, this application relates to connectors with additional features that facilitate ease of orientation and mating and result in a redundant seal.

2. Description of the Prior Art

As a preface, it should be noted that "male" and "female" designations for electrical connectors are not used consistently in the field. Some connectors are designated as "male" because their inserts are received into the shells of the mating connectors, regardless of whether their electrical contacts are sockets, pins (or blades, etc.), or a combination of sockets and pins. ("Insert," as used herein, designates that part of the connector which holds the contacts in position and electrically insulates them from each other and from the shell. The insert need not be a separate removable component of a connector assembly, as is the case with many cylindrical connector assemblies, and it may include the portion of a bonded unitary connector which performs the same function. The "shell" designates the outside case or outer surface of the connector.) Other connectors (e.g. D-subminiture connectors) are designated as "male" because their pin contacts are received into the socket contacts of the mating connectors, regardless of the fact that the shells of the male connectors receive the inserts of the female connectors. Furthermore, a connector pair may be arranged with no shell overhang so that neither connector's shell receives the insert of the mating connector. Thus, "male" and "female" designations as used herein are assigned by preference of the inventor for differentiating between complementary connectors in a connector pair. The terms are not meant to be used in any limiting manner.

Other connector gender designations are also used in the electrical connector field, for instance the terms "plug" and "receptacle." As colloquially used, the insert of a "plug" is received into the shell of a "receptacle." Both plugs and receptacles are known in the art to have pins, sockets or a combination of pins and sockets. However, the "plug" and "receptacle" terminology is also subject to alternative meanings. For instance, "plug" is also defined as a connector which is designed to terminate a free end of a cable or cord, and "receptacle" is defined as a connector which is fixed to a bulkhead, wall, chassis, or panel. In other words, the "plug" is the movable connector and the "receptacle" is the fixed connector, regardless of which insert is received into which shell or which connector has pin contacts, socket contacts, etc. Using the latter terminology, when two cables are joined, the "plug-style" connector is often referred to as a "plug" and the "cable-connecting-receptacle-style connector" is often referred to as a "cable connecting plug." Notwithstanding the above definitions, as used herein, the term "plug" simply refers to that portion of a connector insert which is received into the shell of the other, and the term "receptacle" simply refers to that portion of a connector shell which receives the insert of the other.

When there is a requirement for joining electrical conductors or optical fibers that are to be deployed under water or in humid environments, it is preferable to use connectors that are constructed in such a manner as to offer ease of mating and waterproof integrity. An O-ring, gasket, or packing is typically used to seal the cable end of a connector when repairability or modifiability is a required feature. Alternatively, the connector may be potted, adhesively bonded, or overmolded to create a seal between the cable jacket and the connector if re-entry is not required. However, sealing the interface between two mated connectors has traditionally been limited to the use of gaskets or O-rings which are compressed so that they conform to adjacent surfaces, thereby creating a fluid-proof barrier or seal which can be repeatedly mated and unmated.

The common interface between two connectors is most often sealed by only one sealing element, which is compressively engaged to effect the seal. The sealing element may be a separate and discreet piece which makes up the connector, or it may be an integral part of a unitary molded connector. A connector pair having only one interface sealing element provides no sealing redundancy, so that a defective seal at the connector interface is likely to destroy the integrity of the connection.

To provide redundancy, some waterproof or moisture-resistant connector pairs employ two interface sealing elements disposed on a portion of a connector insert. For example, FIG. 1 shows two sealing elements (9, 10) disposed on a plug (12) of a male connector (8) which is bonded to a cable (13). The compliant seals (9, 10) may be raised ridges integrally bonded to the connector insert, or they may be separate members, such as O-rings which are seated in O-ring grooves. FIG. 1 also depicts a prior art female connector (I) bonded to a cable (2). The male connector (8) is structured to mate with the female connector (1). The entire body of the female connector (1) and the entire body of the male connector (8) each commonly consists of a single molding of an elastomeric material such as rubber or polyurethane. The female connector (1) includes a shell (6) defining a barrel-shaped receptacle (5), and the male connector (8) includes an insert (14) defining a cylinder-shaped plug (12) which is designed and arranged to be inserted into the receptacle (5). The diameter of the plug (12) may be slightly larger than the inside diameter of the receptacle (5), provided the shell (6) of the female connector is made of a conformal material.

The female connector (1) of prior art is illustrated in FIG. 1 with a contact socket (7) that is electrically coupled to a conductor in the cable (2). The male connector (8) correspondingly includes a contact pin (11) that is electrically coupled to a conductor in the cable (13). The contact pin (11) has a diameter, shape and length required to correctly mate with the contact socket (7). Although the female connector is illustrated with a socket contact, it may alternatively have a pin contact, and the male connector may have a corresponding socket contact. Additionally, even though only one pin/socket arrangement is illustrated in FIG. 1, multiple pin and sockets are often used to couple multiple conductors.

As shown in FIG. 1, the cylindrical plug (12) of the male connector (8) of prior art has either two O-rings (each housed within an O-ring groove) or two integral and compliant coaxial protuberances (9, 10) disposed around the plug circumference. The protuberances (9, 10) have a generally cross-sectional hemispheric shape and emulate O-rings in both form and function. The barrel-shaped receptacle (5) of the female connector (1) includes on its interior side surface two coaxial grooves (3, 4) each having a generally cross-sectional hemispheric form. The grooves (3, 4) are designed and arranged to form O-ring grooves for receiving O-rings or protruding ridges (9, 10) while maintaining the compliant sealing elements (9, 10) in compression.

As illustrated in FIG. 1, the prior art connector pairs that feature redundant seals are known to have the sealing elements arranged such that in the process of mating the connector pair, both of the sealing elements (9, 10) do not engage simultaneously. The first distal sealing element (10) (with respect to the cable (13)) is positioned in tandem with the second proximal sealing element (9) so that the first must be engaged, i.e. compressed, before the second sealing element can be engaged. Referring to FIG. 1, the sequence of events during the mating operation is as follows: First, the plug (12) of the male connector (8) is inserted into the receptacle (5) of the female connector (1) until the pin (11) begins to engage its respective socket (7). Next, the penetration continues until the distal sealing ridge (10) is received into receptacle (5) and is finally seated in the distal groove (4) (with respect to the cable (2)). As the penetration continues, the distal sealing ridge (10) disengages from the distal groove (4) and moves to and engages with the proximal groove (3). Simultaneously, the proximal protuberance (9) engages the distal groove (4). In other words, in the process of mating a connector pair, the connector pair must pass over one seal before reaching the final sealing position during the mating operation.

When the distal sealing ridge (10) is disposed within the receptacle (5) but is not engaged in either groove (3) or (4), it is significantly deformed by compression. Because it requires more force to move one connector relative to other when a sealing element is significantly compressed therebetween, it is more difficult for one to mate the connector pair. Hence, operators become accustomed to applying a greater force to mate redundantly-sealed connectors then is customary for mating single-seal connectors, thereby increasing the likelihood of damaging one or more contact pins. If the connectors are initially misaligned, then the operator may not tactilely recognize the misalignment and instead apply too great a force, in turn bending one or more pins. Furthermore, with the prior art connector pair of FIG. 1, it is more difficult for the operator to tactilely feel if both sealing elements have engaged or whether only one sealing element has engaged.

3. Identification of Objects of the Invention

The primary object of the invention is to overcome and correct the aforementioned problems associated with the prior art by providing a connector pair having dual sealing elements at the connector interface that first engage simultaneously.

Another object of the invention is to provide a connector pair which promotes a tactile indication to an operator that the connection between the connector pair is complete and correct.

Another object of the invention is to provide a connector pair with improved waterproof or moisture-resistant characteristics.

Another object of the invention is to provide a connector pair with redundant seals which minimize the force required to mate the connectors.

Another object of the invention is to provide a connector pair which minimize the potential for bending or breaking contacts during the mating process.

SUMMARY OF THE INVENTION

The features identified above, as well as other features of the invention are incorporated in an apparatus for producing a watertight connection for the purpose of joining electrical or optical circuits. In a preferred embodiment, a male connector includes an insert which defines a cylindrical plug with an outer end surface and an outer side surface. The male connector includes one or more electrical or optical contacts such as sockets or pins. The plug of the male connector is characterized by having a first groove disposed about the outer side surface at a first longitudinal distance from the outer end surface and a first compliant sealing element protruding about the outer side surface at a second longitudinal distance from the outer end surface, such that the sealing element is farther from the outer end surface than the groove.

A female connector includes a shell which defines a receptacle with an inner end surface and an inner side surface. The female connector includes one or more electrical or optical contacts which correspond to the male connector contacts for mating purposes. The receptacle of the female connector is characterized by a second compliant sealing element protruding about the inner side surface approximately at the first longitudinal distance from said inner end surface and a second groove disposed about the inner side surface approximately at the second longitudinal distance from the inner end surface. In other words, the receptacle is arranged and designed to removably receive the plug such that the sealing element of the plug is received in the groove of the receptacle, and vice versa, thereby operatively coupling the contacts in a redundantly sealed environment.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

Figure 1:
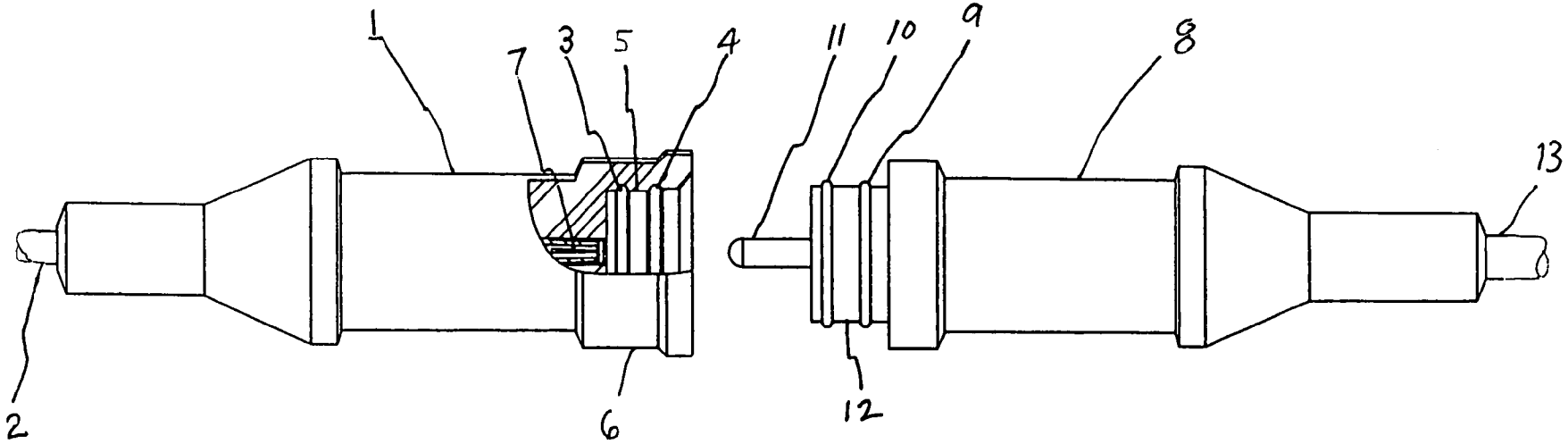
FIG. 1 (PRIOR ART)
FIG. 1 is a side view in partial cross-section of a connector pair of prior art arranged for a redundant seal showing a male cable connector with a contact pin and two compliant sealing O-rings or ridges and a corresponding female cable connector with a contact socket and grooves to receive the compliant sealing O-rings or ridges.
Figure 2:
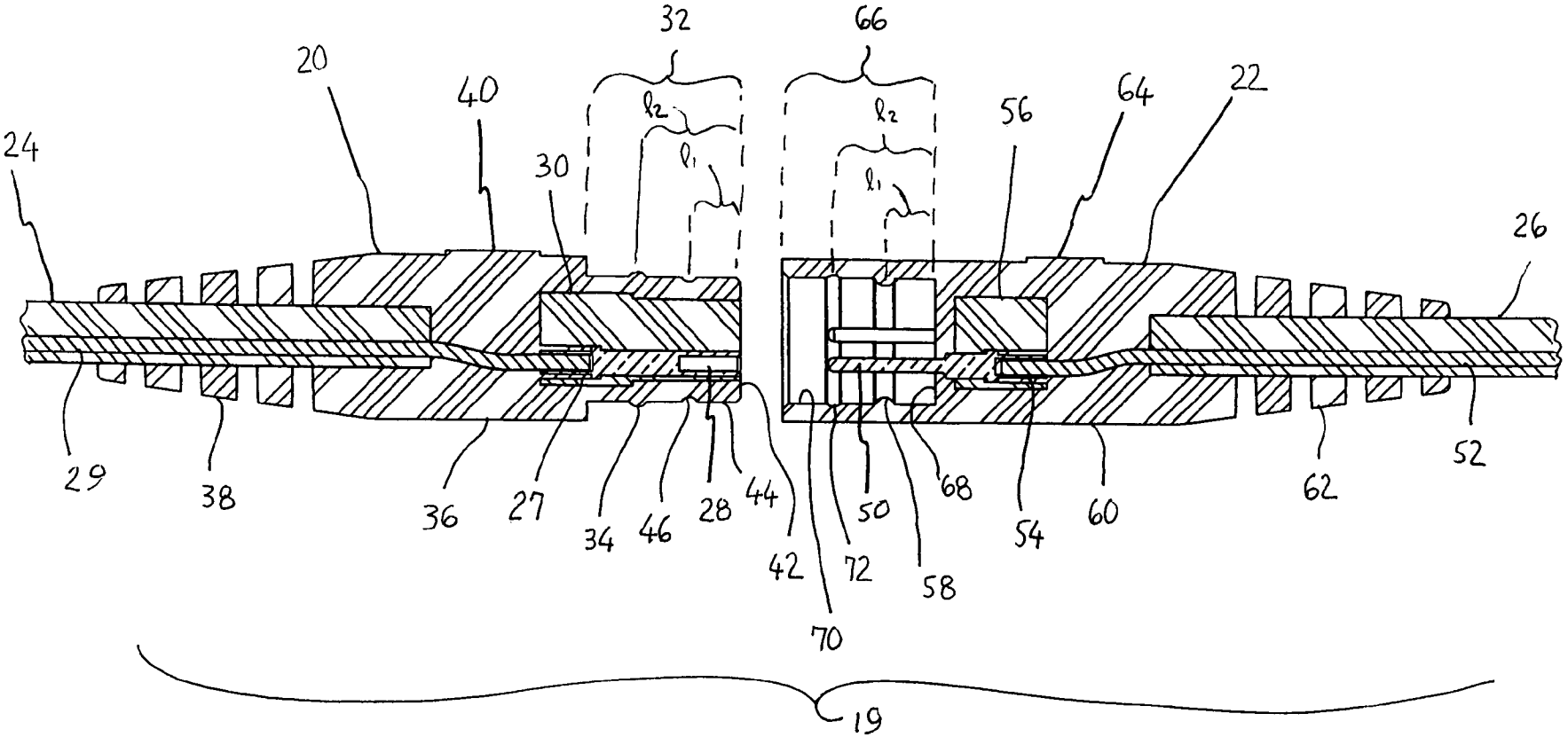
FIG. 2 is a cross sectional view of a connector pair according to one embodiment of the invention showing the male connector having one sealing protuberance and one sealing-element-receiving groove and the female connector having one complementary sealing-element-receiving groove and one complementary sealing protuberance.

FIG. 2 depicts a connector pair 19 according to a first embodiment of the invention. The connector pair includes a male connector 20 which terminates cable 24 and a female connector 22 which terminates cable 26. The male connector 20 is designed and arranged to couple with the female connector 22.

The male connector 20 preferably includes contact sockets 28 that are electrically connected to conductors 29 in cable 24 (and/or optically connected to optical fibers in cable 24). However, contact pins, blades, spades, or similar devices may be used in place of or in addition to contact sockets as appropriate. For electrical connections, the conductors 29 are typically crimped within or soldered to tailpiece portions 70 of the contacts 28, although other suitable termination methods may be used. Any number of contacts 28 may be included as required for the application.

The contact sockets 28 are preferably seated in an insert 30 which holds the contact sockets 28 in position and which electrically (and/or optically) insulates them from each other. The insert 30 is preferably made of a ceramic or semi-rigid plastic dielectric material, although softer materials may be used, depending on the application. The insert 30 and a portion of the cable 24 are preferably overmolded, for example, by a compression molding technique, to form a completed connector, preferably including a first sealing element 34, a shell 36, a strain-relief tail 38 in the backshell region, and alignment indicia 40. The unitary overmolding preferably consists of an elastomeric material such as rubber or polyurethane, although other suitable materials may be used. In an alternative embodiment (FIG. 5), rather than using a discreet member, the insert 30 is formed by the overmolding process and is integral with the shell 36 and the first sealing element 34.

A distal portion of the insert 30 generally forms a cylindrical plug 32, although other non-cylindrical plug shapes may be used. The plug 32 includes an outer end surface 42 and an outer side surface 44. The outer side surface 44 includes one groove 46 and one sealing protuberance or ridge 34. The sealing ridge 34 acts like a compliant O-ring for seating in a groove 72 disposed in the mating female connector 22, and the groove 46 serves as a groove for accepting a sealing ridge 58 of mating female connector 22. Ideally, the groove 46 and ridge 34 are coaxially aligned with the cylindrical plug 32. Furthermore, the groove 46 and ridge 34 each ideally have a generally cross-sectional hemispheric shape. However, other sealing element profiles are known in the art and may be used as appropriate. Groove 46 is located distally (i.e., toward outer end surface 42) of ridge 34. In other words, groove 46 is located a distance $l_1$ from outer end surface 42, and ridge 34 is located a distance $l_2$ from the outer end surface, where $l_2$ is greater than $l_1$.

As illustrated in FIG. 2, the female connector 22 preferably includes contact pins 50 that are electrically connected to conductors 52 in cable 26 (and/or optically connected to optical fibers in cable 26). However, contact sockets, blades, spades, or similar devices may be used in place of or in addition to contact pins as appropriate, provided their layout matches and their styles complement the contacts 28 in mating male connector 20. For electrical connections, the conductors 52 are typically crimped within or soldered to tailpiece portions 54 of contacts 50, although other suitable termination methods may be used. Any number of contacts 50 may be included as required for the application.

The contact pins 50 are preferably seated in an insert 56 which holds the contact pins 50 in position and which electrically (and/or optically) insulates them from each other. The insert 56 is preferably made of a ceramic or semi-rigid plastic dielectric material, although softer materials may be used, depending on the application. The insert 56 and a portion of the cable 26 are preferably overmolded, for example, by a compression molding technique, to form a completed connector, preferably including a second sealing element 58, a shell 60, a strain relief tail 62 in the backshell region, and alignment indicia 64. The unitary overmolding preferably consists of an elastomeric material such as rubber or polyurethane, although other suitable materials may be used. In an alternate embodiment (FIG. 5), rather than using a discreet member, the insert 56 is formed by the overmolding process and is integral with the shell 60.

A distal portion of the shell 60 generally forms a barrel-shaped receptacle 66, although other non-cylindrical receptacles may be used, provided the receptacle shape is designed and arranged to removably receive the plug 32 of the male connector 20. The outer diameter of the plug 32 may be slightly greater than the inner diameter of the receptacle 66 to improve compression and sealing upon mating. The receptacle 66 includes an inner end surface 68 and an inner side surface 70. The inner side surface 70 includes one groove 72 and one sealing protuberance or ridge 58. The sealing ridge 58 acts like a compliant O-ring for seating in groove 46 in the mating male connector 20, and the groove 72 serves as a groove for accepting the sealing ridge 34 of mating male connector 20. Ideally, the groove 72 and ridge 58 are coaxially aligned with the barrel-shaped receptacle 66. Furthermore, the groove 72 and ridge 58 each ideally have a generally cross-sectional hemispheric shape. However, other sealing element profiles are known in the art and may be used as appropriate. Groove 72 is located distally (i.e., away from inner end surface 68) of ridge 58. Specifically, in order to ensure that male connector 20 and female connector 22 properly mate and that the dual sealing elements 34, 58 engage simultaneously, groove 72 is located approximately the distance $l_2$ from the inner end surface 68, and ridge 58 is located approximately the distance $l_1$ from the inner end surface 68. In other words, the distal groove 72 of the female connector 22 is located about the same distance from the inner end surface 68 of the receptacle 66 as the proximal ridge 34 of the male connector 20 is located from the outer end surface 42 of the plug 32. Similarly, the proximal ridge 58 of the female connector 22 is located about the same distance from the inner end surface 68 of the receptacle 66 as the distal groove 46 of the male connector 20 is located from the outer end surface 42 of the plug 32. Thus, when the connector pair 20, 22 is mated, male connector sealing ridge 34 is seated in female connector groove 72, and female connector sealing ridge 58 is seated in male connector groove 46.

Elevated markers 40 and 64 are provided on male connector 20 and female connector 22, respectively, to provide both a visual and a tactile indication of the proper connector orientation to facilitate the mating process. Markers 40, 64 are preferably integrally molded as part of the connector shell 36, 60, respectively.

Figure 3:
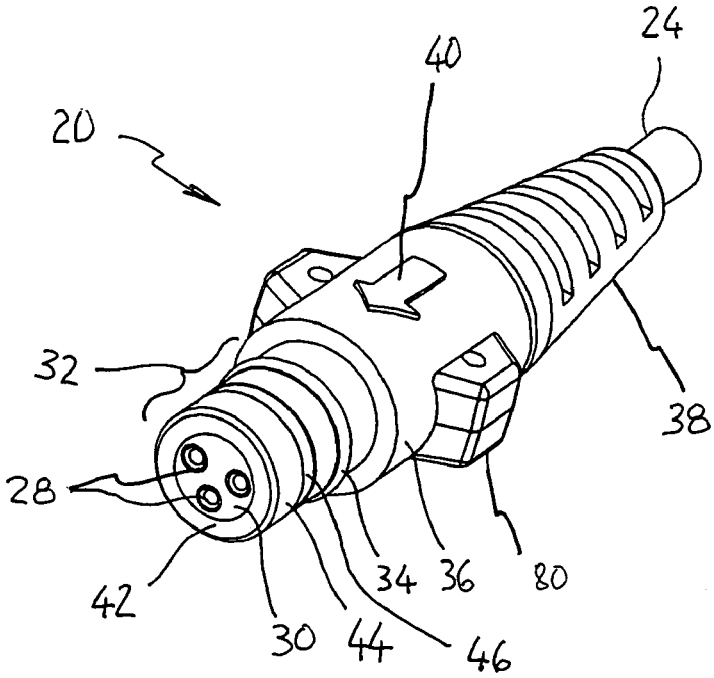
FIG. 3 is a perspective view of the male connector of FIG. 2.

FIG. 3 is a perspective view of the male connector 20 of FIG. 2. The outer end surface 42 of male connector 25 shows a three socket 28 arrangement that is compatible with its designated mating female connector 22 of FIG. 4. A strain relief 38 is provided for cable protection by limiting the bend radius at the point of junction with the cable. An elevated arrow-shaped marker 40 is provided to aid in orientation of the connectors prior to mating. Two perforated protrusions 80 are provided to allow for the installation of lock wire to prevent inadvertent uncoupling of the connectors or for the installation of wired seals to prohibit tampering. Additionally, the locking tabs or protrusions 80 improve the ability of an operator to grip the connector. A compliant sealing ridge 34 and a sealing groove 46 are shown circumscribing the other side surface 44 of plug 32.

Figure 4:
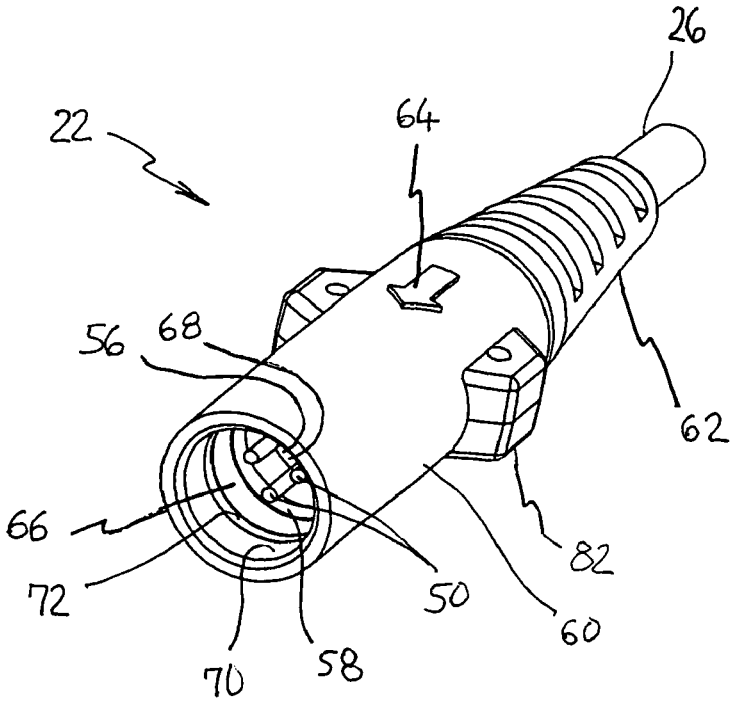
FIG. 4 is a perspective view of the female connector of FIG. 2.

FIG. 4 is a perspective view of the female connector 22. This connector 22 contains a three pin 50 arrangement located within the cylindrical receptacle 66 that is compatible with the arrangement of mating male connector 20 of FIG. 3. Like the male connector, the female connector 22 includes a strain relief bend restrictor 62, orientation indicia 64, and locking tabs or protrusions 82. A compliant sealing ridge 58 and sealing groove 72 circumscribe the inner side surface 70 of receptacle 66.

Referring to FIGS. 2–4, the sequence of events during the mating operation of connector pair 19 is as follows: First, the male connector 20 is inserted into the female connector 22 after orientation of the pins 50 and sockets 28 using tactile markers 40, 64. Next, the plug 32 of connector 20 freely moves within the receptacle 66 of connector 22 as the two distal grooves 46 and 72 pass each other without encumbrance. As penetration continues, both sealing protuberances 34 and 58 encounter their respective grooves 72 and 46 and become simultaneously engaged. This action results in an advantage in that a single and positive sensation is sensed in the hands of the person making the installation and insures complete and correct mating. The embodiment of the invention is advantageous over prior connectors which produce two separate sensations of lesser intensity that can result in uncertainty when working in darkness and in difficult environmental conditions.

Figure 5:
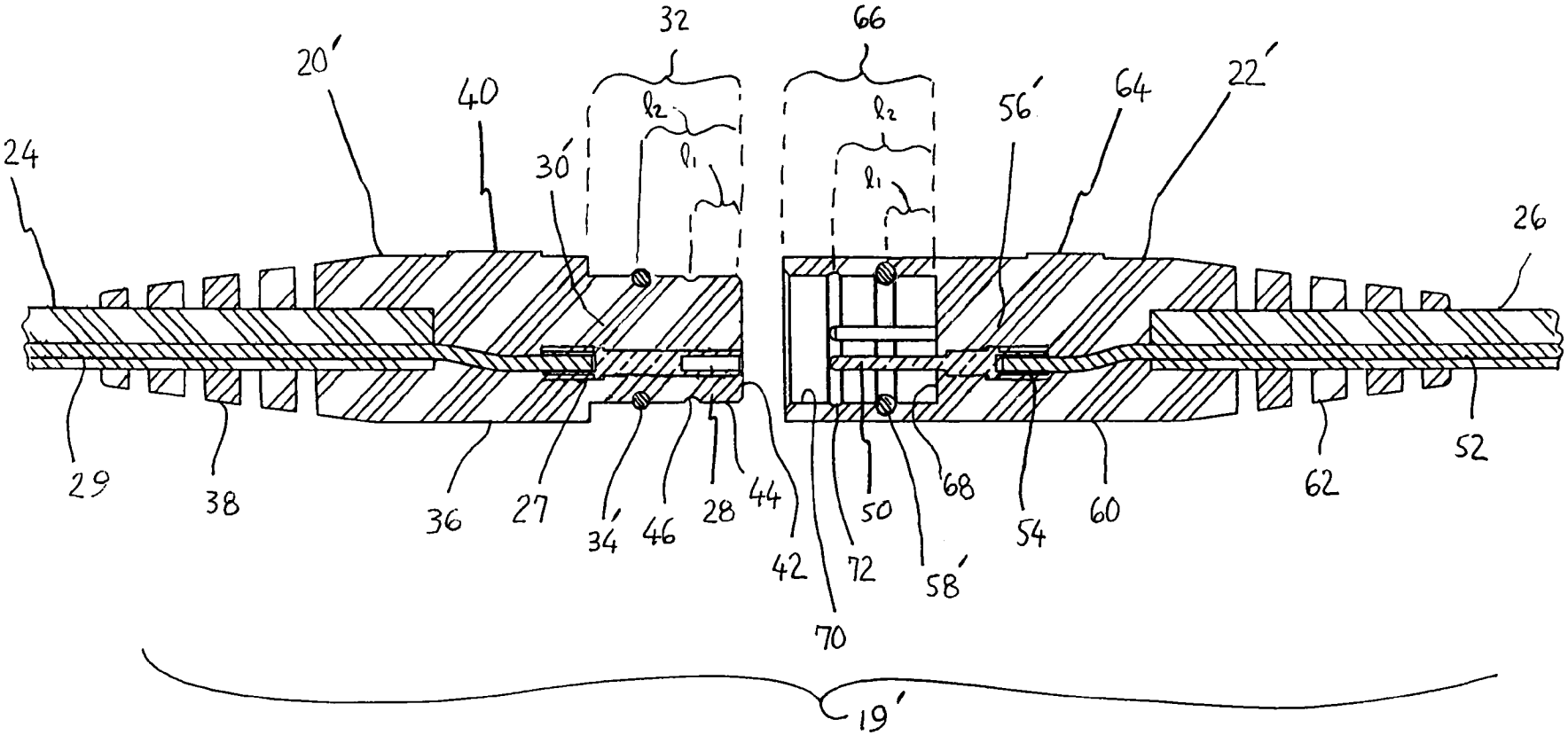
FIG. 5 is a cross sectional view of a connector pair according to an alternative embodiment of the invention showing the connector pair of FIG. 2 where the sealing protuberances are formed by O-rings.

FIG. 5 shows connector pair 19' according to an alternate embodiment of the invention, wherein the integral sealing ridges 34 and 58 of FIG. 2 are replaced by discreet O-rings 34' and 58'. FIG. 5 also illustrates the option of having insert 30' of the male connector 20' and the insert 56' of female connector 22' formed as an integral part of the connector shell during the overmolding process. The other features of the embodiment of FIG. 5 remain as described for the embodiment of FIG. 2.

The Abstract of the disclosure is written solely for providing the United States Patent and Trademark Office and the public at large with a means by which to determine quickly from a cursory inspection the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. A connector pair (19) comprising:

a male connector (20) defining a plug (32) with an outer end surface (42) and an outer side surface (44), said male connector including a first communications path (28) terminating generally at said plug, said plug characterized by having a first sealing groove (46) disposed about said outer side surface at a first longitudinal distance (11) from said outer end surface of said male connector and a first compliant sealing element protruding about said outer side surface at a second longitudinal distance (12) greater than said first longitudinal distance from said outer end surface of said male connector; and a female connector (22) defining a receptacle (66) with an inner end surface (68) and an inner side surface (70), said female connector including a second communications path (50) terminating generally at said receptacle, said receptacle characterized by a second compliant sealing element (58) protruding about said inner side surface approximately at said first longitudinal distance (11) from said inner end surface and a second sealing groove (72) disposed about said inner side surface approximately at said second longitudinal distance (12) from said inner end surface;

said first sealing groove having a diameter greater than the diameter of said second compliant sealing element so as to compress said second compliant sealing element when said connector pair is mated;

said second sealing groove having a diameter less than the diameter of said first compliant sealing element so as to compress said first compliant sealing element when said connector pair is mated;

said receptacle arranged and designed to sealably and removably receive said plug thereby operatively coupling said first communications path with said second communications path.

2. The connector pair (19) of claim 1 wherein:

said first and second communications paths (28, 50) are electrically conductive.

3. The connector pair (19) of claim 2 further comprising:

a contact pin (50); and a contact socket (28).

4. The connector pair (19) of claim 1 wherein said male connector (20) further comprises:

an insert (30) holding a contact (28), said insert at least partially encapsulated by a shell (36).

5. The connector pair (19') of claim 4 wherein:

said insert (30') is integral with said shell (36).

6. The connector pair (19) of claim 1 wherein said female connector (22) further comprises:

an insert (56) holding a contact (50), said insert at least partially encapsulated by a shell (60).

7. The connector pair (19') of claim 6 wherein:

said insert (56') is integral with said shell (60).

8. The connector pair (19) of claim 1 wherein:

said first compliant sealing element (34) of said male connector (20) is a compliant ridge integral with said outer side surface (44) of said plug (32).

9. The connector pair (19') of claim 1 wherein:

said first compliant sealing element (34') of said male connector (20') is an O-ring.

10. The connector pair (19) of claim 1 wherein:

said second compliant sealing element (58) of said female connector (22) is a compliant ridge integral with said inner side surface (70) of said receptacle (66).

11. The connector pair (19') of claim 1 wherein:

said second compliant sealing element (58') of said female connector (22') is an O-ring.

12. The connector pair (19) of claim 1 further comprising:

a first elastomeric shell (36) defining an exterior of said male connector (20); and a second elastomeric shell (60) defining an exterior of said female connector (22).

13. In a connector pair (19) including a female connector (22) having a receptacle (66) which mates with a complimentary male connector (20) having a plug (32), the improvement comprising:

a first sealing element (34) circumferentially disposed about said plug of said male connector;

a first sealing groove (46) circumferentially formed about said plug of said male connector;

a second sealing element (58) circumferentially disposed within said receptacle of said female connector; and a second sealing groove (72) circumferentially formed within said receptacle of said female connector such that when said male connector is mated with said female connector, said first sealing element aligns with and is received in said second groove and said second sealing element aligns with and is received in said first groove;

said first sealing groove having a diameter greater than the diameter of said second sealing element so as to compress said second sealing element when said connector pair is mated;

said second sealing groove having a diameter less than the diameter of said first sealing element so as to compress said first sealing element when said connector pair is mated;

whereby said first and second sealing elements and said first and second sealing grooves cooperate to form a redundant sealing arrangement for said connector pair.

14. The connector pair of claim 13 wherein:

said plug defines an outer end surface (42) and an outer side surface (44); said receptacle defines an inner end surface (68) and an inner side surface (70);

said first sealing groove is disposed closer to said outer end surface than said first sealing element; and said second sealing groove is disposed farther from said inner end surface than said second sealing element.

15. The connector pair of claim 14 wherein:

said first sealing element (34) of said male connector (20) is a compliant ridge integral with said outer side surface (44) of said plug (32).

16. The connector pair (19') of claim 14 wherein:

said first sealing element (34') of said male connector (20') is an O-ring.

17. The connector pair (19) of claim 14 wherein:

said second sealing element (58) of said female connector (22) is a compliant ridge integral with said inner side surface (70) of said receptacle (66).

18. The connector pair (19') of claim 14 wherein:

said second sealing element (58') of said female connector (22') is an O-ring.

* * * * *